United States Patent [19]

Ross

[11] 4,300,416

[45] Nov. 17, 1981

[54] KEY BLANK IMPRESSIONING TOOL

[75] Inventor: William D. Ross, Kansas City, Mo.

[73] Assignee: William D. Ross Manufacturing Corporation, Kansas City, Mo.

[21] Appl. No.: 84,620

[22] Filed: Oct. 15, 1979

[51] Int. Cl.[3] ..... B25B 9/00; B25B 19/00; B21K 13/00

[52] U.S. Cl. ..... 81/463; 81/3R; 76/110; 70/394

[58] Field of Search ..... 70/394, 460; 76/110; 29/254, 255, 275, 276; 81/3 R, 52.35, 52.3, 463; 173/93, 93.7

[56] References Cited

U.S. PATENT DOCUMENTS

| | | | |
|---|---|---|---|
| 1,054,687 | 3/1913 | Grigg | 81/52.3 |
| 1,403,753 | 1/1922 | Epstein | 81/3 R |
| 2,727,312 | 12/1955 | Tampke | 70/394 |
| 2,763,027 | 9/1956 | Tampke | 70/394 |
| 3,106,012 | 10/1963 | Comer | 29/254 |
| 3,791,012 | 2/1974 | Jenkin | 81/52.35 |

*Primary Examiner*—Roscoe V. Parker

*Attorney, Agent, or Firm*—Schmidt, Johnson, Hovey & Williams

[57] ABSTRACT

A key blank impressioning tool has a pair of pivotally, interconnected parts for manipulation by the hands of the user. As one of the parts is grasped by one hand to apply torque to the key blank in the keyway of the lock to in turn tend to turn the plug of the lock, the second part of the tool is used by the other hand of the operator for the purpose of reciprocating a block so as to strike light blows of such nature as to create indentations in one edge of the blank to thereby identify the location and depth of the tumbler cuts to be made in the key blank.

10 Claims, 5 Drawing Figures

KEY BLANK IMPRESSIONING TOOL

Locksmiths skilled in the art of duplicating lost keys from key blanks universally use a so-called impressioning method wherein attempts are made to determine where the tumbler cuts are to be filed in the blank and also determine the proper depth of each such cut.

It is of course understandable that the newly cut key will not operate satisfactorily if the tumbler cuts are not properly located and if they are either too deep or too shallow. The method requires extreme dexterity and a high degree of sensitivity in the hands of the locksmith to the position of certain component parts of the lock, especially the rotatable plug thereof and its associated tumblers. Therefore, for the most part, only highly skilled and carefully trained workmen have been able to reproduce keys rapidly and with the kind of accuracy required for subsequent trouble-free use.

In order to carry out the operation, the key blank must be grasped with some type of tool while it is within the keyway of the lock, the blank must be turned ever so slightly, and while so held, tapping forces must be applied so as to produce the needed impression in the key blank. For the most part, the only tools now readily available and best suited for the operation, are the well known vice grip types of pliers. Their use, at best, does not always produce satisfactory results without accompanying, time-consuming difficulties.

There is, therefore, a dire need for a tool of the kind which forms the subject matter of my present invention wherein is incorporated within a single assembly, not only the instrumentality necessary for applying the proper torque to the key blank, but the required components for effecting gentle blows that are transmitted to the key blank while it is within the keyway so as to cause the plug tumblers to mark, indent or impress one edge of the key blank, thereby providing the locksmith with a visual indication of exactly where the tumbler cuts are to be made and provide him with the information needed for controlling the depth of each cut.

Figure 1:
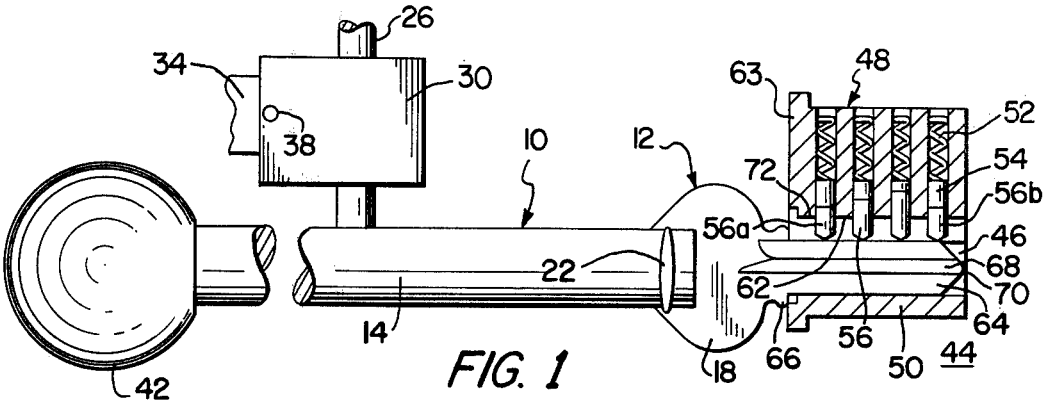
FIG. 1 is a fragmentary side elevational view of a key blank impressioning tool made according to my present invention showing the same as it is used with the key blank inserted in the keyway of a lock, such lock being also shown fragmentarily and in section.

The tool 10 shown in the drawing for impressioning a key blank 12 includes a device in the nature of an elongated rod 14 having a key blank receiving slot 16 at one end thereof within which perforated bow 18 of the blank 12 may be snugly inserted and held in place by connecting means in the nature of a releasable fastener such as a bolt 20 provided with a wing 22 on one end and a wing nut 24 on its opposite end. The bolt 20, carried by the rod 14, passes radially therethrough, across the slot 16 and through the perforation (not shown) in the bow 18.

A guide in the nature of an elongated stem 26 is rigidly secured to the rod 14 intermediate its ends and extends radially therefrom, terminating in a head 28. A striking member in the nature of a compact block 30 of substantial weight and material has a hole 32 therein which receives the stem 26 for rotation of the block 30 about the longitudinal axis of the stem 26 and for reciprocable movement of the block 30 along said axis of the stem 26 between the rod 14 and the head 28.

A manually operable handle in the nature of an elongated bar 34 has one end thereof extending into a bar receiving slot 36 formed in the block 30. A pivot element, such as a cross pin 38, provides a means for attaching one end of the bar 34 to the block 30 for swinging movement of the bar 34 about the pin 38 relative to the block 30 toward and away from the rod 14. The pin 38 traverses the block 38 across the slot 36 and through an opening 40 in the bar 34.

A spherical hand grasp 42 is secured to the rod 14 at that end thereof opposite the slot 16 for applying torque to the rod 14. Although not shown in the drawing, that end of the bar 34 opposite the opening 40 therein extends beyond the grasp 42 when the rod 14 and the bar 34 are in spaced, parallel alignment as illustrated. However, in use such relative position of the rod 14 and the bar 34 is not necessarily mantained inasmuch as convenience may dictate offsetting the bar 34 laterally of the rod 14 as is made possible by the rotatability of the block 30 on the stem 26. Moreover, the position of the lock 44 will determine the position of the stem 26; it will not necessarily always extend vertically, upwardly from the rod 14 during use as is shown in the drawing.

Manifestly there are multitudes of differing types of locks in connection with which the tool 10 may be used, and the keys therefor also differ widely. The lock 44 shown in the drawing and the blank 12 have, therefore, been chosen for illustrative purposes only.

The pin tumbler lock 44 has a keyway 46 into which the blank 12 is inserted after attachment to the rod 14 as above described and as shown in FIG. 1. A shell 48 houses a rotatable plug 50, within which the keyway 46 is formed, together with a number of springs 52 each engaging a top tumbler pin 54 that, in turn, engages a corresponding bottom tumbler pin 56 which normally extends into the plug 50 to hold it against rotation and, therefore, in a locked position.

Figure 2:
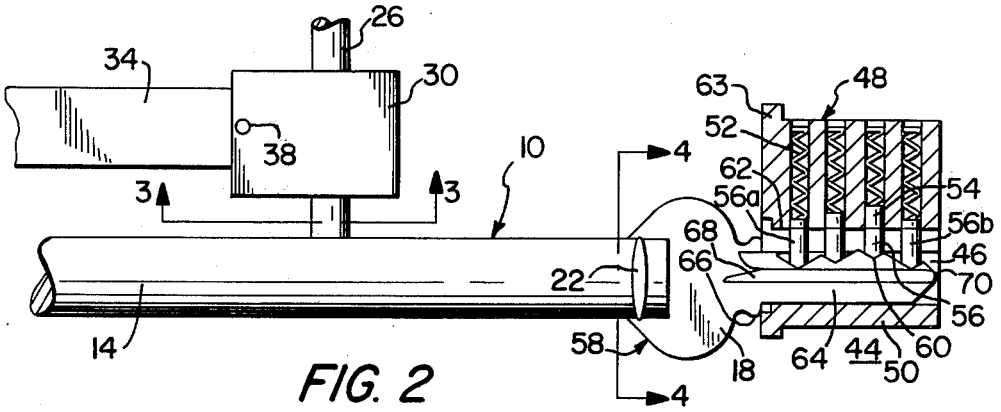
FIG. 2 is a view similar to FIG. 1 illustrating the tool connected with the finished key inserted in the lock in a manner similar to FIG. 1.
Figure 3:
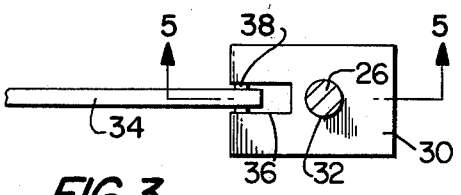
FIG. 3 is a fragmentary cross-sectional view taken on line 3—3 of FIG. 2.
Figure 4:
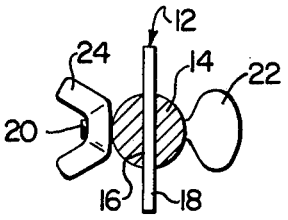
FIG. 4 is a cross-sectional view taken on line 4—4 of FIG. 2.
Figure 5:
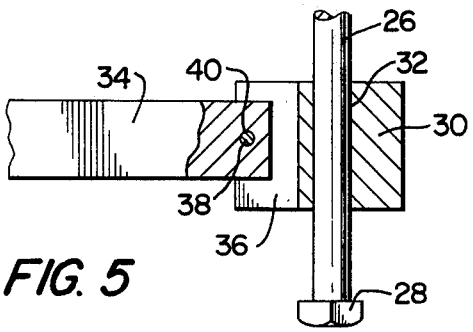
FIG. 5 is a fragmentary cross-sectional taken on line 5—5 of FIG. 3.

When a proper key 58 is inserted into the keyway 46, as shown in FIG. 2, the cuts 60 in the key 58 move the bottom pins 56 up to a sheer line 62. This, in turn, raises the top pins 54 to the sheer line 62 and compresses the springs 52, permitting rotation of the plug 50 by the key 58 to an unlocked position. Obviously, during rotation of the plug 50, the pins 54 are held against the plug 50 by the springs 52 and the pins 56 are prevented from radial movement out of the plug 50 by the body 63 of the shell 48.

Therefore, with the other hand of the operator manipulating the bar 34 to tap the block 30 against the rod 14, the blank 12 is canted downwardly, viewing FIG. 1, causing an indentation or impression in the edge 72 by the innermost pin 56*a*. Conversely, tapping on the head 28 will cant the blank 12 in the opposite direction to cause an impression in the edge 72 by the outermost pin 56*b*. Hence, the need for application of torque to the plug 50 to hold the pins 56 against undue movement toward the springs 52 during the tapping operation.

It is to be noted further that there is normally a certain amount of frictional resistance to movement of the pins 54 in the body 63 such that they also provide some impediment to movement of the pins 56 while the torque is maintained during formation of the marks or impressions in the edge 72 of the blank 12.

The next step is to remove the blank 12 from the keyway 46 and file away or otherwise cut into the blank 12 at the edge 72 sufficiently only to remove the impressions. The steps are then repeated until all the cuts 60 are formed in the blank 12, producing the finished key 58, capable of unlocking the plug 50.

From the foregoing, it can now be appreciated that inasmuch as the pins 56 are normally quite sensitive to movement in a direction and amount such as to make it difficult to cause them to indent the edge 72, locksmiths have heretofore been forced to acquire a high degree of skill and sensitivity to the pin movement and have not always been able to quickly, easily and accurately produce keys from blanks capable of operating the locks as successfully as could be accomplished by use of the original keys.

Therefore, the grasp 42 for applying just the right amount of torque and, more particularly, the bar 34 for proper manipulation of the block 30 become extremely important features of the tool 10. If the torque is either too great or too light, good results cannot always be expected; the spherical nature of the grasp 42 causes the operators hand to be especially sensitive to the action being imparted to the pins 56 through the rod 14. Also, by use of the bar 34, the operator has complete control of the block 30 such as to permit him to apply just the right amount of striking force on the rod 14 and on the head 28.

In this connection then, it is to be herein disclosed that my efforts to publicly commercialize a tool of this nature which was devoid of the bar 34 and of a spherical type grasp more than one year prior to the filing of the instant application met with little success and I make no claim thereto as an embodiment of my present invention.

I claim:

1. A key blank impressioning tool comprising:

an elongated rod having means at one end for connecting the same with the key blank and means at the other end for transmitting torque thereto while the key blank is in a lock and as the rod is hand manipulated;

a striking member for imparting repeated blows to said rod while torque is applied to said blank such as to produce indentations in the blank as the result of impact forces transmitted thereto from the rod;

a guide rigidly secured to the rod and extending laterally therefrom for reciprocably mounting the striking member on the rod; and a manually operable handle having means at one end attaching the same to the striking member and means at the other end remote from said one end for operating said handle whereby the torque transmitting means of said rod is grasped in one hand of the user to apply torque to said blank while the operating means of said handle is grasped by the other hand of said user to strike light blows of such nature so as to create said indentations in one edge of said blank.

2. The invention of claim 1, said attaching means comprising a pivot element.

3. The invention of claim 2, said handle comprising an elongated bar extending from the member in a direction opposite said connecting means.

4. The invention of claim 3, said member comprising a compact block of substantial weight and material having a bar-receiving slot therein, one end of the bar extending into the slot, said element comprising a pin carried by the block, extending across the slot through the bar and disposed for swinging movement of the bar relative to the block toward and away from said rod.

5. A key blank impressioning tool comprising:

a device having means for connecting the same with the key blank and transmitting torque thereto while the same is in a lock and as the device is hand manipulated;

a striking member for imparting repeated blows to said device while torque is applied to said blank such as to produce indentations in the blank as the result of impact force transmitted thereto from the device;

a guide for reciprocably mounting the member on the device;

a manually operable handle having means attaching the same to the member, said attaching means comprising a pivot element, said handle comprising an elongated bar extending from the member in a direction opposite said connecting means, said member comprising a compact block of substantial weight and material having a bar-receiving slot therein, one end of the bar extending into the slot, said element comprising a pin carried by the block, extending across the slot through the bar and disposed for swinging movement of the bar relative to the block toward and away from said device, said device comprising an elongated rod having a hand grasp on one end thereof remote from said connecting means for applying torque to the rod.

6. The invention of claim 5, said grasp being spherical.

7. The invention of claim 6, said guide comprising an elongated stem rigid to the rod radially thereof and intermediate its ends.

8. The invention of claim 7, said stem having a head remote from the rod for receiving blows from said block.

9. The invention of claim 8, said bar extending at the opposite end thereof beyond said grasp.

10. The invention of claim 9, said rod having a key blank receiving slot at that end thereof opposite the grasp, said connecting means comprising a releasable fastener carried by the rod, extending across the key blank receiving slot and extending through the key blank when the latter is in the key blank receiving slot.

* * * * *